US008362384B2

(12) United States Patent
Mortun

(10) Patent No.: US 8,362,384 B2
(45) Date of Patent: Jan. 29, 2013

(54) ANTI-BUCKLING HOUSING FOR SPRING WITHIN A SWITCH ASSEMBLY

(75) Inventor: Sorin Ioan Mortun, Irvington, NY (US)

(73) Assignee: Hubbell Incorporated, Shelton, CT (US)

( * ) Notice: Subject to any disclaimer, the term of this patent is extended or adjusted under 35 U.S.C. 154(b) by 257 days.

(21) Appl. No.: 12/776,675

(22) Filed: May 10, 2010

(65) Prior Publication Data

US 2011/0272265 A1 Nov. 10, 2011

(51) Int. Cl.
*H01H 21/24* (2006.01)

(52) U.S. Cl. ..... 200/557

(58) Field of Classification Search ..... 200/557, 200/553, 339

See application file for complete search history.

(56) References Cited

U.S. PATENT DOCUMENTS

| | | | | |
|---|---|---|---|---|
| 1,940,716 | A | 12/1933 | Hubbell, Jr. | |
| 3,740,511 | A | 6/1973 | Westmoreland | |
| 4,075,449 | A | 2/1978 | Yagi et al. | |
| 4,203,017 | A | 5/1980 | Lee | |
| 4,418,254 | A | 11/1983 | Busby et al. | |
| 4,490,591 | A | 12/1984 | Page | |
| 5,041,706 | A | 8/1991 | Osika et al. | |
| 6,388,221 | B1 * | 5/2002 | Rudolph et al. | 200/556 |
| 6,566,619 | B2 * | 5/2003 | Gillman et al. | 200/339 |
| 6,570,114 | B1 * | 5/2003 | Czarnecki | 200/553 |
| 6,797,905 | B1 | 9/2004 | Wang et al. | |
| 6,841,744 | B1 | 1/2005 | Kodo et al. | |
| 6,857,357 | B2 * | 2/2005 | Fujii | 100/339 |
| 7,339,129 | B2 * | 3/2008 | Shatley | 200/339 |
| 7,449,632 | B2 | 11/2008 | Wang | |
| 2008/0099321 | A1 * | 5/2008 | Kiyono et al. | 200/557 |

* cited by examiner

*Primary Examiner* — Vanessa Girardi

(74) *Attorney, Agent, or Firm* — Marcus R. Mickney; Mark S. Bicks; Alfred N. Goodman

(57) ABSTRACT

A switch assembly includes a cover connected to a base to form a switch housing and a toggle switch movably connected to the housing. The toggle switch has a lower portion disposed within the housing and a handle disposed externally of the housing such that movement of the handle moves the toggle switch between off and on positions. A spring is disposed within the housing. A first end of the spring is connected to the base and a second end of the spring is connected to the lower portion of the toggle switch. A spring housing is disposed over at least a portion of the spring to prevent buckling of the spring when the spring moves with the toggle switch. By substantially preventing spring buckling, the switch assembly is safer and has a longer life.

21 Claims, 10 Drawing Sheets

ANTI-BUCKLING HOUSING FOR SPRING WITHIN A SWITCH ASSEMBLY

FIELD OF THE INVENTION

The present invention relates to an anti-buckling housing for an actuating spring of a switch assembly. More particularly, the present invention relates to a switch assembly in which a housing receives an actuating spring to substantially prevent its buckling during operation of a toggle switch of the switch assembly.

BACKGROUND OF THE INVENTION

To make a switch assembly safe, durable, and reliable, the contact members are held firmly together under a positive force when the switch is closed and held apart under a positive force when the switch is open. Manipulating the toggle switch of the switch assembly closes and opens the contact members quickly.

A spring stores the energy necessary to provide a snap action of the switch assembly, thereby facilitating the quick opening and closing of the contact members. The quick making and breaking of the contact members reduces arcing and resultant damage to the contact members. Accordingly, a need exists for a switch assembly that facilitates opening and closing the contact members quickly.

The spring that provides the snap action to the toggle switch can buckle when manipulating the toggle switch to open and close the contact members. Buckling of the spring impairs the opening and closing of the contact members, resulting in a slow switch operation, reduced opening and closing force of the contact members, damage to the contact members and reduced life of the switch assembly. Accordingly, a need exists for a switch assembly in which the spring is substantially prevented from buckling.

SUMMARY OF THE INVENTION

Accordingly, it is a primary objective of the present invention to provide an improved switch assembly in which an actuating spring is substantially prevented from buckling.

A further objective of the present invention is to provide a housing in which the actuating spring is disposed to substantially prevent spring buckling.

Another objective of the present invention is to substantially prevent spring buckling to provide a safer and longer lasting switch assembly.

The foregoing objectives are basically attained by a switch assembly having a cover connected to a base to form a switch housing and a toggle switch movably connected to the switch housing. The toggle switch has a lower portion disposed within the switch housing and a handle disposed externally of the switch housing such that movement of the handle moves the toggle switch between off and on positions. A spring is disposed within the switch housing. A first end of the spring is connected to the base and a second end of the spring is connected to the lower portion of the toggle switch. A spring housing is disposed over at least a portion of the spring to prevent buckling of the spring when the spring moves with the toggle switch.

The foregoing objectives are also basically attained by a switch assembly having a cover connected to a base to form a switch housing. First and second contact terminals are connected to the switch housing. A contact arm is connected to the first contact and has a first contact member disposed at a free end of the contact arm. A second contact member is connected to the second contact terminal. A toggle switch has a lower portion disposed within the housing and a handle disposed externally of the housing such that movement of the handle moves the toggle switch between off and on positions. A trunnion is disposed on the toggle switch and engages the contact arm. A spring is disposed within the switch housing. A first end of the spring is connected to the base and a second end of the spring is connected to the lower portion of the toggle switch. A spring housing is disposed over at least a portion of the spring to prevent buckling of the spring when the spring moves with the toggle switch. When the toggle switch is in the on position, the trunnion moves the contact arm such that the first contact member contacts the second contact member. When the toggle switch is in the off position, the trunnion allows movement of the contact arm away from the second contact terminal such that the first contact member is spaced from the second contact member.

Other objects, advantages and salient features of the invention will become apparent from the following detailed description, which, taken in conjunction with the annexed drawings, discloses a preferred embodiment of the invention.

As used in this application, the terms "front," "rear," "upper," "lower," "upwardly," "downwardly," and other relative orientational descriptors are intended to facilitate the description of the switch assembly, and are not intended to limit the structure of the switch assembly to any particular position or orientation.

BRIEF DESCRIPTION OF THE DRAWINGS

The above aspects and features of the present invention will be more apparent from the description for an exemplary embodiment of the present invention taken with reference to the accompanying drawings, in which.

Throughout the drawings, like reference numerals will be understood to refer to like parts, components and structures.

DETAILED DESCRIPTION OF AN EXEMPLARY EMBODIMENT

Figure 6:
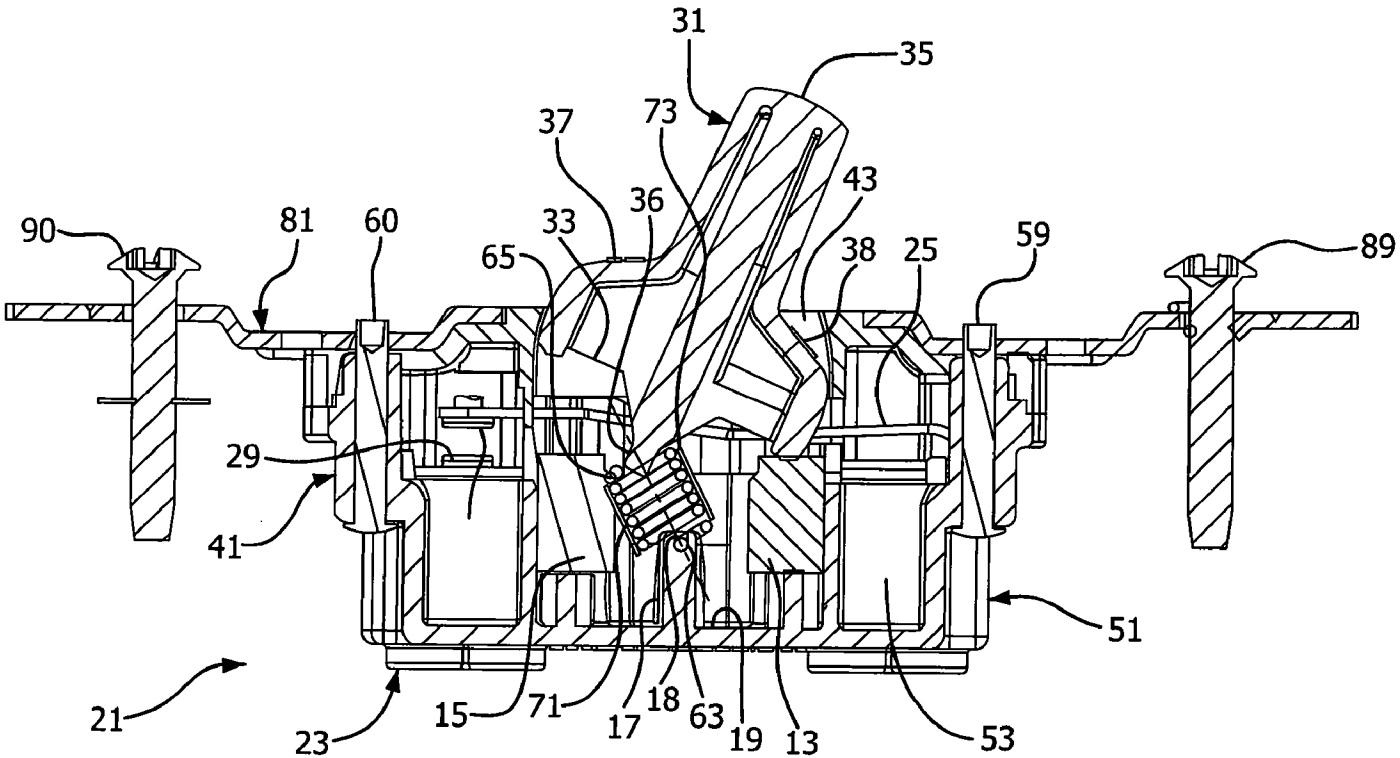
FIG. 6 is a side elevational view in cross section of the switch assembly of FIG. 1 in the off position.
Figure 7:
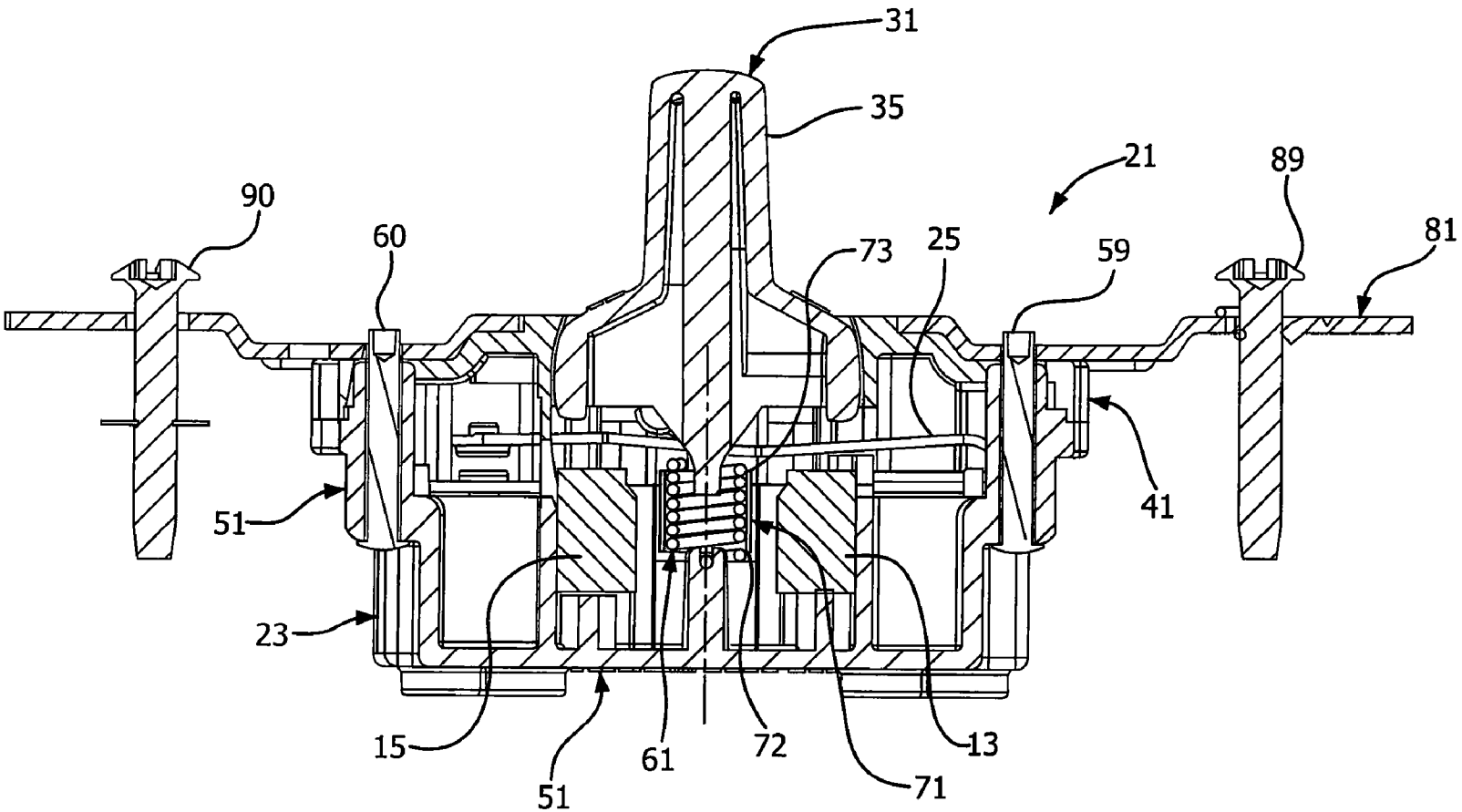
FIG. 7 is a side elevational view in cross section of the switch assembly of FIG. 1 between the off and on positions.
Figure 8:
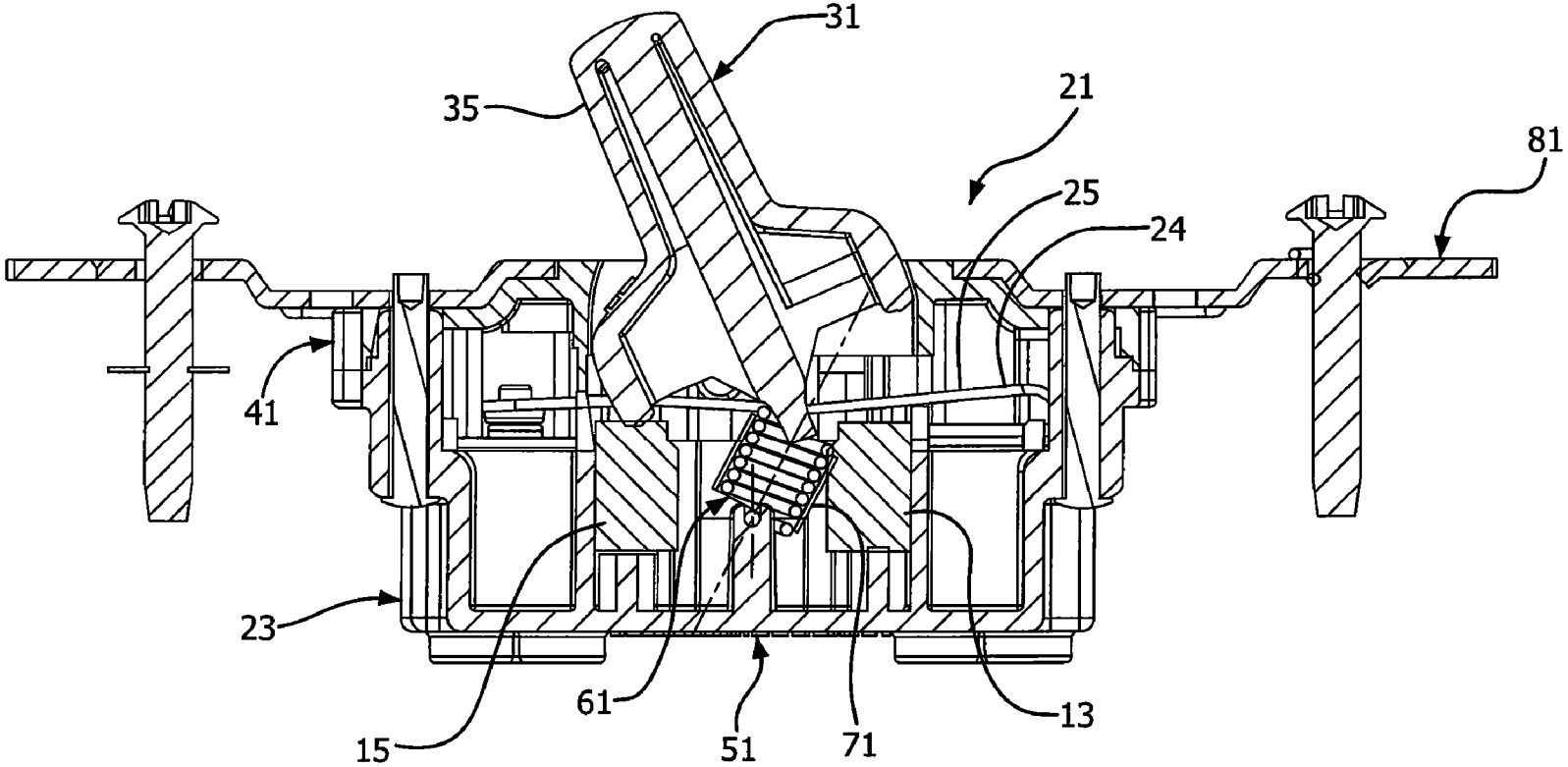
FIG. 8 is a side elevational view in cross section of the switch assembly of FIG. 1 in the on position.
Figure 9:
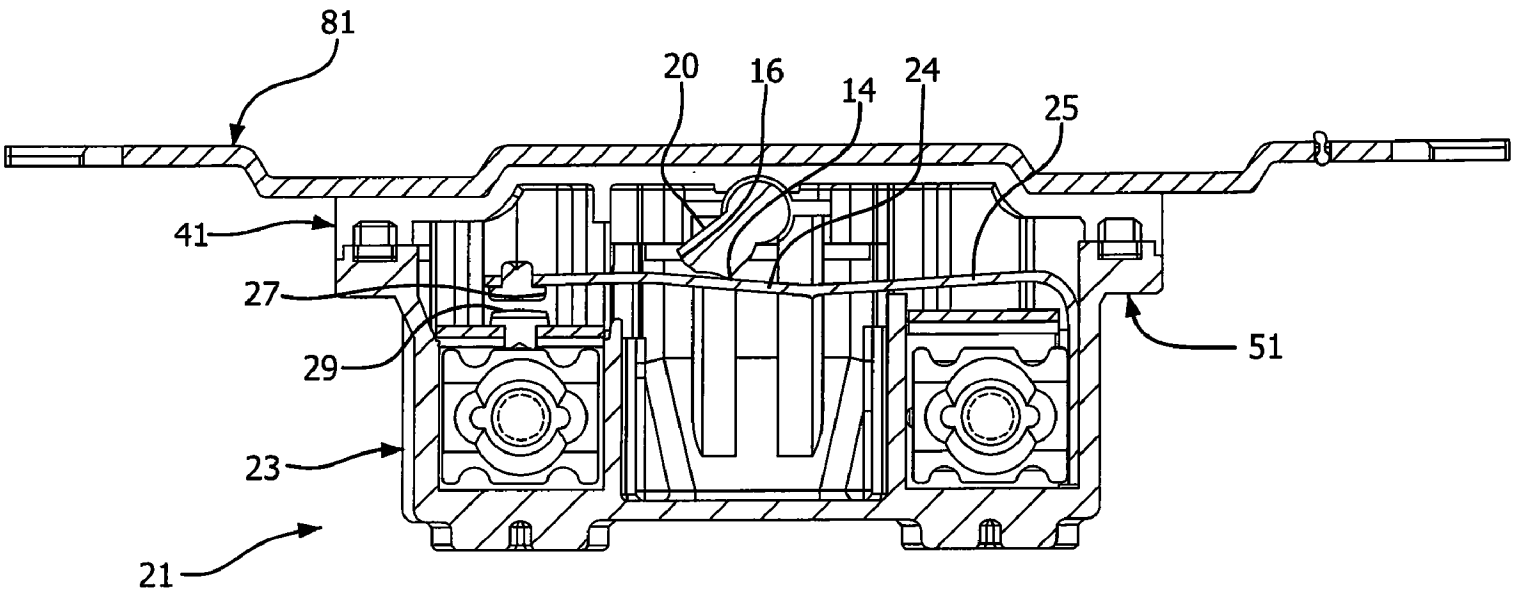
FIG. 9 is a side elevational view in cross section of the switch assembly of FIG. 1 showing a trunnion of a toggle switch engaging a contact arm in the off position.
Figure 10:
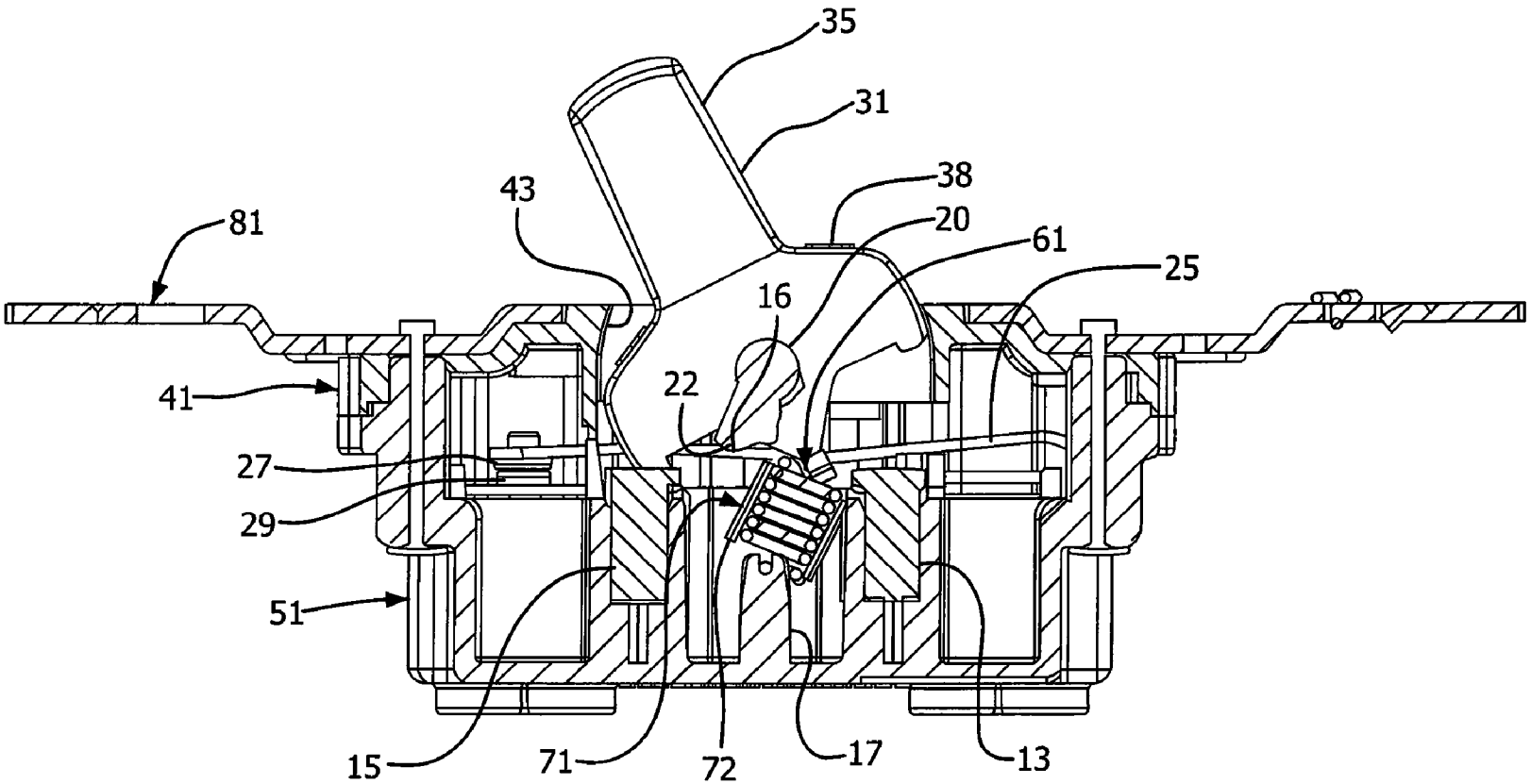
FIG. 10 is a side elevational view in cross section of the switch assembly of FIG. 1 showing the trunnion of the toggle switch engaging a contact arm in the on position.

As shown in FIGS. 1-10, a switch assembly 21 controls the flow of electrical power in a circuit. When a toggle switch 31 is in a first, or off, position, as shown in FIGS. 6 and 9, the flow of electrical power through the circuit is interrupted. When the toggle switch 31 is in a second, or on, position, as shown in FIGS. 8 and 10, electrical power is allowed to flow through the circuit. A cover 41 is connected to a base 51 to form a switch housing 23. A toggle switch 31 is movably connected to the switch housing 23. The toggle switch 31 has a lower portion 33 disposed within the switch housing 23 and a handle 35 disposed externally of the switch housing such that movement of the handle moves the toggle switch between off and on positions. An actuating spring 61 is disposed within the switch housing 23. A first end 63 of the spring 61 is connected to the base 51 and a second end 65 of the spring is connected to the lower portion 33 of the toggle switch 31. A spring housing 71 is disposed over at least a portion of the spring 61 to prevent buckling of the spring when the spring moves with the toggle switch 31.

Figure 1:
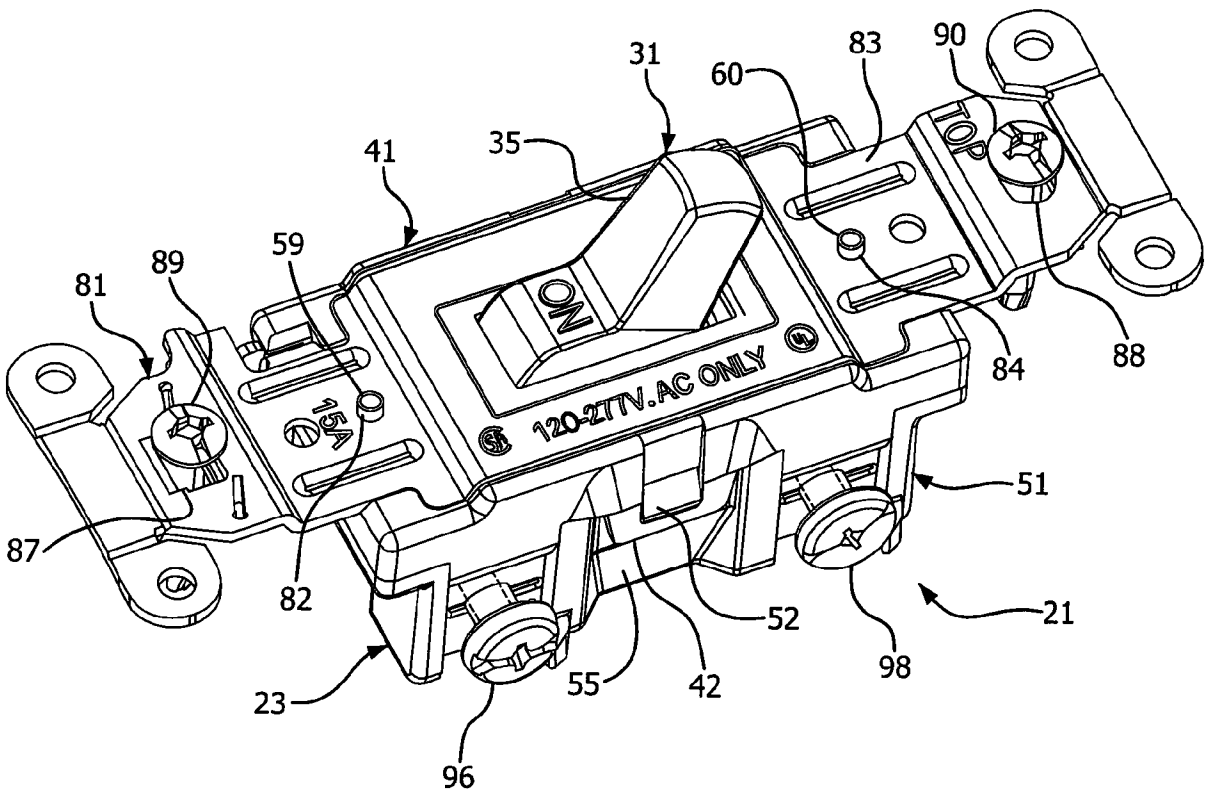
FIG. 1 is a perspective view of a switch assembly according to an exemplary embodiment of the present invention.
Figure 2:
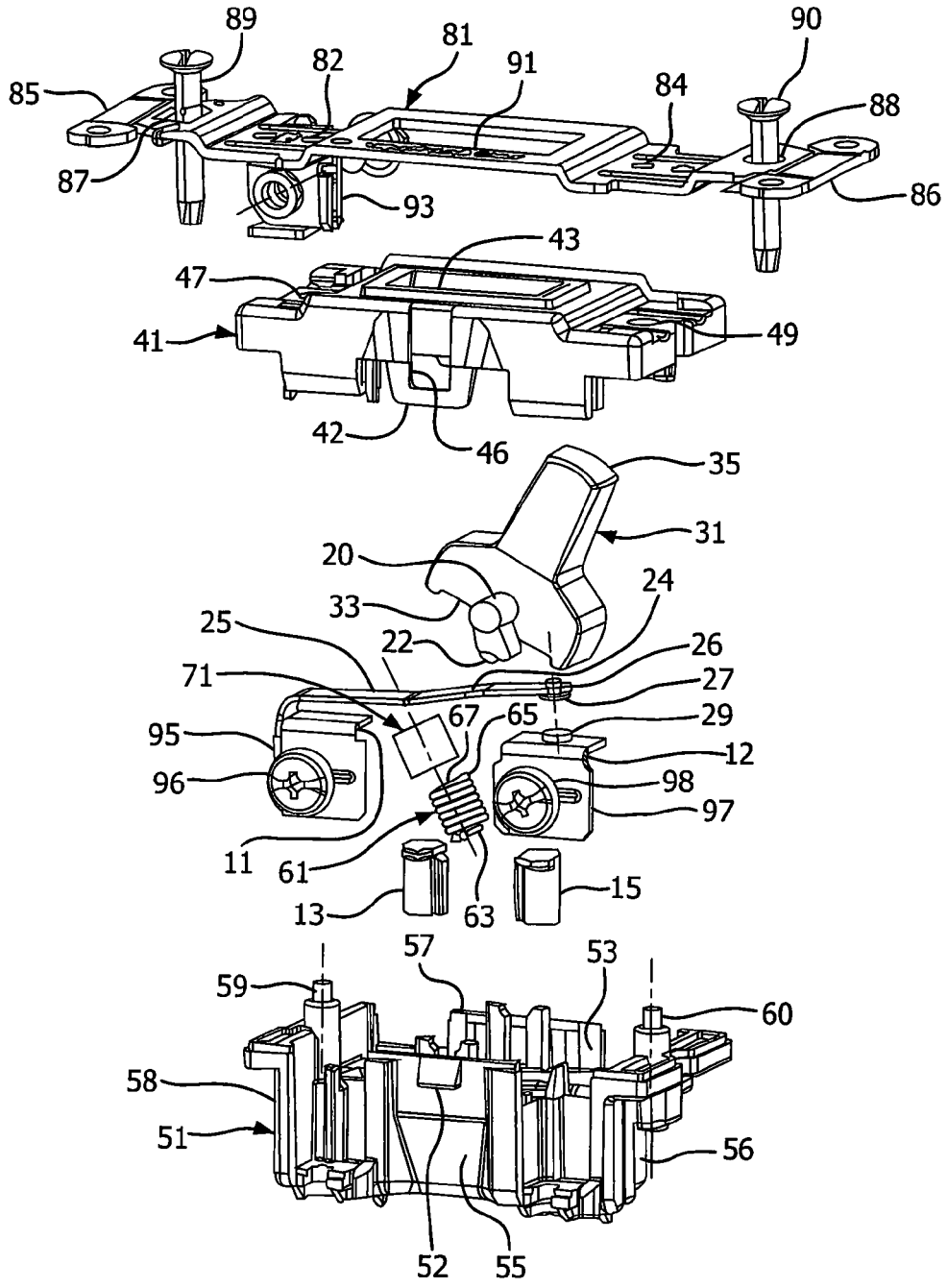
FIG. 2 is an exploded perspective view of the switch assembly of FIG. 1.

As shown in FIGS. 1 and 2, the switch assembly 21 includes the base 51 connected to the cover 41 to define a switch housing 23. The cover 41 has an opening 43 therein that movably receives the toggle switch 31. A pair of oppositely disposed latching members 42 and 44 extend downwardly from the cover 41. Each latching member 42 and 44 is preferably substantially U-shaped, thereby forming an opening 46 and 48 to receive projections 52 and 54 connected to the base 51. An upper surface 45 of the cover 41 has openings 47 and 49 to receive posts connected to the base 51.

The base 51 has first, second, third and fourth walls 55-58 that define a cavity 53 between the base and the cover 41. Upwardly extending posts 59 and 60 are disposed at opposite ends of the base 51 and are received by the openings 47 and 49 in the cover 41, as shown in FIG. 1. Oppositely disposed projections 52 and 54 extend outwardly from sides 55 and 57 of the base 51 and are received by openings 46 and 48 in the latching members 42 and 44 of the cover 41, thereby forming a snap-fit between the base 51 and the cover 41. A protrusion 17 extends upwardly from an inner surface 19 of the base 51. A recess 18 in the protrusion receives a first end 63 of the spring 61.

Figure 3:
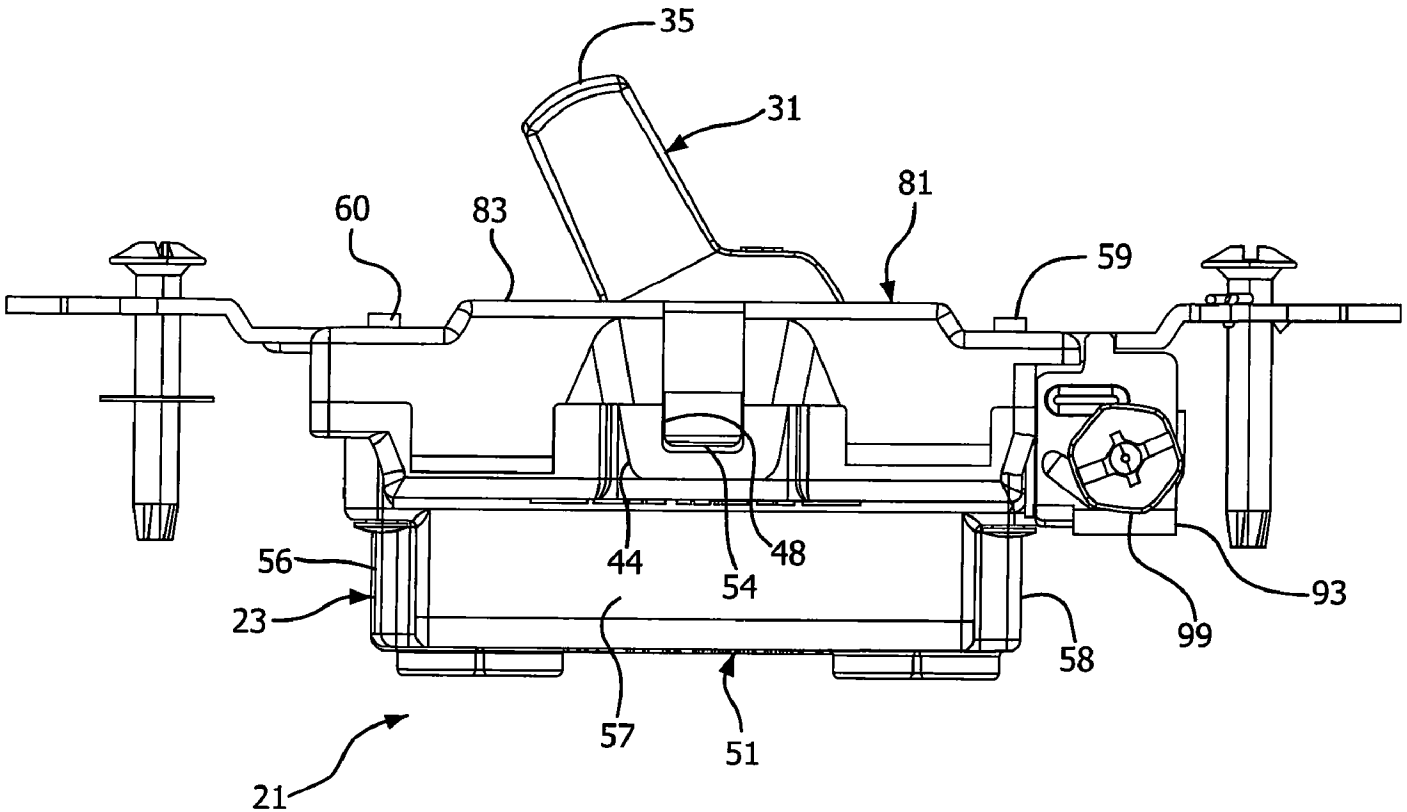
FIG. 3 is a side elevational view of the switch assembly of FIG. 1.

A mounting strap 81 has openings 82 and 84 in an upper surface 83 that are aligned with the openings 47 and 49 in the cover 41 to receive posts 59 and 60 of the base 51, as shown in FIGS. 1 and 3. Opposite ends of the mounting strap have mounting ears 85 and 86 having mounting holes 87 and 88 therein that receive fasteners 89 and 90 to secure the switch assembly 21 to an electrical box (not shown). An opening 91 in the mounting strap 81 is aligned with the opening 43 in the cover 41 to receive the handle 35 of the toggle switch 31. A ground contact terminal 93 is connected to the mounting strap 81. The ground contact terminal 93 may be integrally formed with the mounting strap 81 as a single piece. A fastener 99 is threadably connected to the ground contact terminal 93 to terminate a ground wire (not shown).

The mounting strap 81 is disposed over the cover 41 such that the handle 35 of the toggle switch 31 passes through the opening 91 in the mounting strap. Posts 59 and 60 pass through the base 51, openings 47 and 49 in the cover 41 and through openings 82 and 84 in the mounting strap 81. The posts 59 and 60 may be swaged, as shown in FIG. 10, to secure the base 51, cover 41 and mounting strap 81 together.

Figure 4:
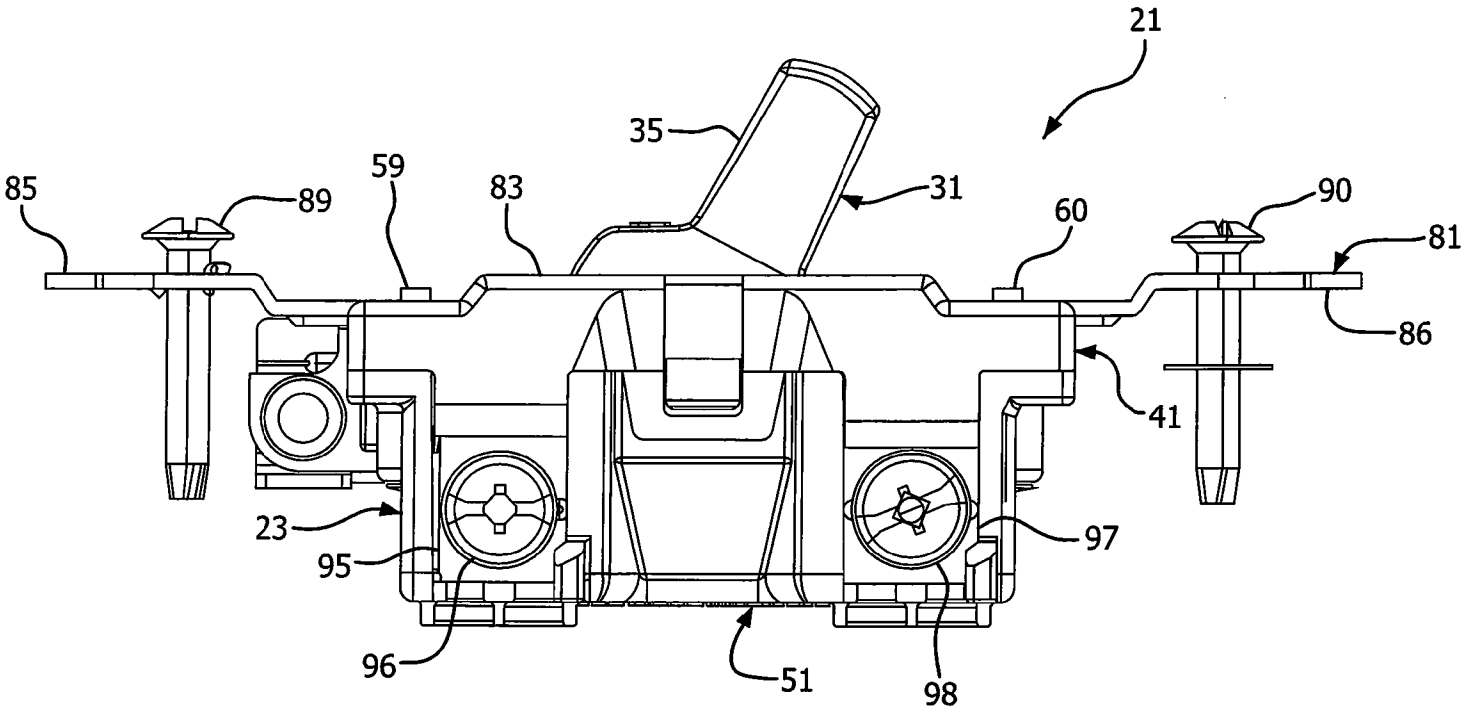
FIG. 4 is an opposite side elevational view of the switch assembly of FIG. 3.
Figure 5:
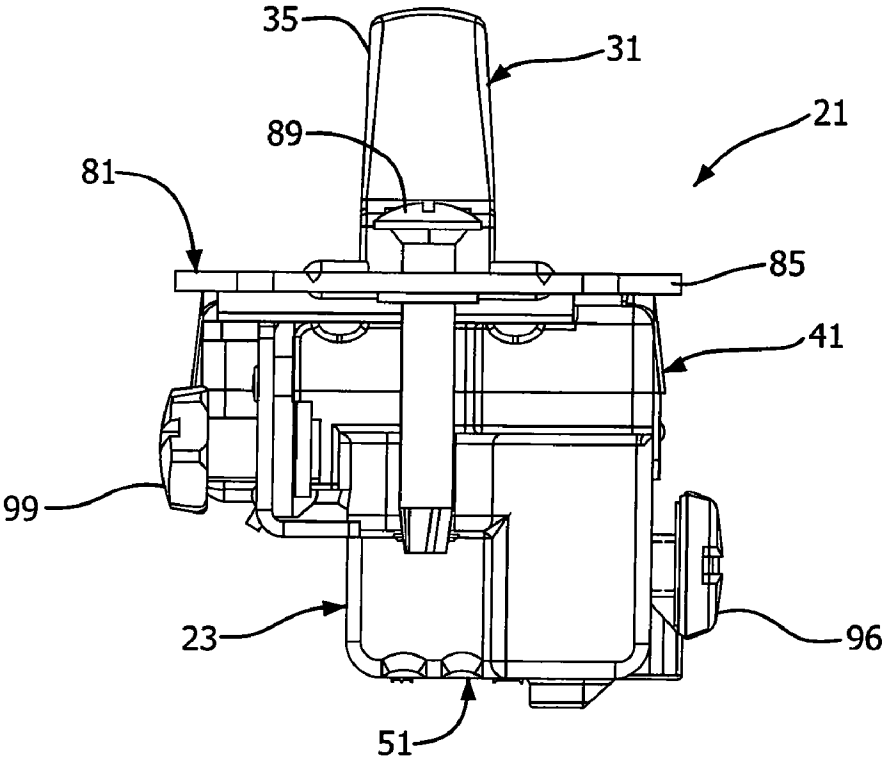
FIG. 5 is a front elevational view of the switch assembly of FIG. 1.

A first contact terminal 95 is partially disposed outside of the switch housing 23, as shown in FIG. 4. A fastener 96 threadably connected to the first contact terminal 95 is adapted to terminate a wire (not shown). A portion 11 of the first contact terminal 95 extends inwardly and is received between the cover 41 and the base 51 to secure the first contact terminal to the switch housing 23, as shown in FIGS. 1, 2 and 4. A flexible contact arm 25 is connected to the first contact terminal 95 and is disposed within the switch housing 23. A first contact member 27 is disposed at a free end 26 of the contact arm 25.

A second contact terminal 97 is partially disposed outside of the switch housing 23, as shown in FIG. 4. A fastener 98 is threadably connected to the second contact terminal 97 to terminate a wire (not shown). A portion 12 of the second contact terminal 97 extends inwardly and is received between the cover 41 and the base 51 to secure the second contact terminal to the switch housing 23, as shown in FIGS. 1, 2 and 4. A second contact member 29 is connected to the second contact terminal 97 and is disposed within the switch housing 23. The second contact member 29 is aligned with the first contact member 27 such that when the contact arm 25 is depressed by the trunnion 20, the first and second contact members engage to close the circuit such that power can flow therethrough.

The toggle switch 31 is disposed in the switch assembly such that a handle 35 thereof extends outwardly through openings 43 and 91 in the cover 41 and mounting strap 81, respectively. A lower portion 33 of the toggle switch 31 is disposed in the cavity 53 of the switch housing 23, as shown in FIGS. 6-10. The lower portion 33 of the toggle switch 31 has a spring receiving member 36 that receives a second end 65 of the spring 61. A first outer surface 37 of the handle 35 has a position indicator indicating that the switch assembly is in the off position. A second outer surface 38 has a position indicator indicating that the switch assembly is in the on position. A trunnion 20 is connected to the toggle switch 31, as shown in FIG. 2. A lower surface 22 of the trunnion 20 has a first portion 14 and a second portion 26 for selectively engaging an upper surface 24 of the contact arm 25. The first portion 14 of the trunnion 20 engages the contact arm 25 when the toggle switch 31 is in the off position. The second portion 16 of the trunnion 20 engages the contact arm 25 when the toggle switch 31 is in the on position. Preferably, a second trunnion, which is substantially identical to the first trunnion 20, is disposed on an opposite side of the toggle switch 31 from the first trunnion to facilitate engagement with the contact arm 25.

The spring 61 has a first end 63 that is connected to the base 51 of the switch housing 23. Preferably, the first end 63 of the spring 61 is received by a recess 18 in the protrusion 17 extending upwardly from an inner surface 19 of the base 51, as shown 6. A second end 65 of the spring 61 is received by the toggle switch 31. Preferably, the spring receiving member 36 of the toggle switch 31 is received by an aperture 67 formed at the second end 65 of the spring 61.

A spring housing 71, as shown in FIGS. 2 and 6-10, is disposed over at least a portion of the spring 61. Preferably, a majority of the spring 61 is disposed within the spring housing 71, as shown in FIG. 8. The spring housing 71 is preferably substantially cylindrical and creates a clearance fit between the spring 61 and the spring housing 71, thereby allowing the spring housing to rotate with respect to the spring. Axial movement of the spring housing 71 with respect to the spring 61 is substantially prevented by the base 51 at a first end 72 of the housing and the toggle switch 31 at a second end 73 of the housing. Preferably, the first end 72 of the spring housing 71 is substantially prevented from axial movement by the protrusion 17, as shown in FIG. 10. Preferably, the second end 73 of the spring housing 71 is substantially prevented from axial movement by the spring receiving member 36, as shown in FIG. 6.

First and second stops 13 and 15 are disposed in the cavity 53 of the switch housing 21 to limit pivotal movement of the toggle switch between the first (off) and second (on) positions. When the toggle switch 31 is in the first position, as shown in FIGS. 6 and 9, the first stop 13 limits further clockwise movement of the toggle switch. In the first position, the first outer surface 37 indicates that the switch assembly 21 is in the off position. When the toggle switch 31 is in the second position, as shown in FIGS. 8 and 10, the second stop 15 limits further counter-clockwise movement of the toggle switch.

The toggle switch 31 is pivotally mounted in the housing 23 with the handle 35 passing through openings 43 and 91 in the cover 41 and mounting strap 81, respectively. The width of the lower portion 33 of the toggle switch 31 is larger than the width of the opening 43 in the cover 41 such that the spring 61 biases the toggle switch upwardly against the cover. Additionally, the spring 61 provides the snap action of the toggle switch as it passes the over-center position, as shown in FIG. 7, when moving between on and off positions.

Power is supplied to the switch assembly 21 through a wire connected to either the first or second contact terminal 95 and 97. Power is supplied to a load, such as an electrical outlet, through a wire connected to the other of the first and second contact terminals 95 and 97. When the toggle switch is in the second position, as shown in FIGS. 8 and 10, the power circuit is closed and power flows through the wire to the first contact terminal 95, through the contact arm 25, through the first contact member 27 to the engaged second contact member 29, and through the second contact terminal 97 to the wire connected to the load. When the toggle switch is in the first position, as shown in FIGS. 6 and 9, the power circuit is open and power is not supplied to the load wire because the flow of power is interrupted by the disengagement of the first and second contact members 27 and 29.

Assembly and Operation

The first and second stops 13 and 15 are disposed in the base 51 of the switch assembly 21. The first end 63 of the spring 61 is connected to the recess 18 of the protrusion 17 and the spring housing 71 is disposed over the spring. The spring receiving member 36 of the toggle switch 31 is connected to the second end 65 of the spring 61. The first and second contact terminals 95 and 97 are connected to the base 51. The cover 41 is then connected to the base 51, such that the handle 35 of the toggle switch passes through the cover opening 43 and portions 11 and 12 of the first and second contact terminals are secured between the base and the cover. Projections 52 and 54 of the base 51 are received in the openings 46 and 48 of the latching members 42 and 44 of the cover 41 to provide a snap-fit between the base and the cover. The mounting strap 81 is disposed over the cover 41 such that the handle 35 of the toggle switch 31 passes through the mounting strap opening 91. Posts 59 and 60 pass through the base 51, openings 47 and 49 in the cover 41 and through openings 82 and 84 in the mounting strap 81. The posts 59 and 60 may be swaged, as shown in FIG. 10, to secure the base 51, cover 41 and mounting strap 81 together. Fasteners 89 and 90 received by fastener holes 87 and 88 in the mounting strap 81 may be used to secure the switch assembly 21 to an electrical box (not shown).

A first wire (not shown) supplying wire to the switch assembly 21 is connected to the first contact terminal 95. The fastener 96 secures the first wire to the first contact terminal 95. A second wire (not shown) is connected to the second contact terminal 97 by the fastener 98 and supplies power to a load. Alternatively, the connections of the first and second wires to the switch assembly may be reversed. A ground wire (not shown) is connected to the ground contact terminal 93 and is secured thereto by the fastener 99 (FIG. 3).

To supply power to the load, the circuit must be closed, which occurs when the first and second contact members 27 and 29 are engaged as shown in FIGS. 8 and 10. To interrupt the supply of power to the load, the circuit must be interrupted, which occurs when the first and second members 27 and 29 are disengaged as shown in FIGS. 6 and 9.

When the switch assembly 21 is in the off position, the first upper surface 37 of the toggle switch 31 indicates such status. To supply power to the load, the toggle switch 31 is pivoted from the off position to the on position, which is counter-clockwise rotation as shown between FIGS. 6 and 8. The second stop 15 prevents further counter-clockwise rotation of the toggle switch 31. When the toggle switch 31 moves between closed and open positions, the spring 61 moves with the toggle switch. The spring 61 is substantially prevented from buckling during such movement by being disposed in the spring housing 71. The trunnion 20 is moved with the toggle switch 31 such that the second portion 16 of the trunnion engages the upper surface 24 of the contact arm 25, thereby depressing the contact arm such that the first contact member 27 is brought into contact with the second contact member 29. The second portion 16 of the trunnion 20 provides a positive force to maintain contact between the first and second contact members 27 and 29.

To interrupt the flow of power to the load, the toggle switch 31 is rotated from the on position (FIGS. 8 and 10) to the off position (FIGS. 7 and 9), which is clockwise rotation of the toggle switch as shown in the figures. This rotation of the toggle switch 31 causes the first portion 14 of the toggle switch to engage the upper surface 24 of the contact arm 25, as shown in FIG. 9. The bias of the contact arm 25 moves the contact arm such that the first contact member 27 is moved away from the second contact member 29, thereby interrupting the circuit. The spring 61 is substantially prevented from buckling during such movement by being disposed in the spring housing 71. The bias of the spring 61 provides a positive force to maintain separation between the first and second contact members 27 and 29.

An over-center position of the toggle switch 31 between the open and closed positions is shown in FIG. 7. When rotating the toggle switch 31 from the closed to open positions (FIG. 8 to FIG. 6), the energy stored in the spring 61 provides snap action to quickly and fully separate the first and second contact members 27 and 29. The first stop 13 stops further movement of the toggle switch 31. When rotating the toggle switch 31 from the open to closed positions (FIG. 6 to FIG. 8), the energy stored in the spring 61 provides snap action to quickly and fully engage the first and second contact members 27 and 29. The second stop 15 stops further movement of the toggle switch 31. By disposing the spring 61 in the spring housing 71, buckling of the spring is substantially prevented and the snap action of the spring beyond the over-center position is facilitated. Accordingly, the anti-buckling spring housing 71 provides quick switch assembly operation, increased opening and closing force of the first and second contact members, reduced damage to the first and second contact members, increased life of the switch assembly and a safer to operate switch assembly.

While a number of advantageous embodiments have been chosen to illustrate the invention, it will be understood by those skilled in the art that various changes and modifications may be made therein without departing from the scope of the invention as defined in the appended claims.

What is claimed is:

1. A switch assembly, comprising:

a base having a protrusion;

a cover connected to the base to form a switch housing;

a toggle switch having a lower portion disposed within said switch housing and a handle disposed externally of said switch housing such that movement of said handle moves said toggle switch between off and on positions;

a spring disposed within said switch housing, a first end of said spring being connected to said protrusion and a second end of said spring being connected to said lower portion of said toggle switch, said protrusion having a recess therein for receiving said first end of said spring; and a spring housing disposed over at least a portion of said spring to prevent buckling of said spring when said spring moves with said toggle switch.

2. A switch assembly, comprising:

a base;

a cover connected to the base to form a switch housing;

a toggle switch having a lower portion disposed within said switch housing and a handle disposed externally of said switch housing such that movement of said handle moves said toggle switch between off and on positions;

a spring disposed within said switch housing, a first end of said spring being connected to said base and a second end of said spring being connected to said lower portion of said toggle switch; and a spring housing disposed over at least a portion of said spring to prevent buckling of said spring when said spring moves with said toggle switch, said spring housing being rotatable about and encircles said spring and rotational movement about a longitudinal axis of said spring housing being limited by said toggle switch at a first end and said base at a second end.

3. A switch assembly, comprising:

a base;

a cover connected to the base to form a switch housing;

a toggle switch having a lower portion disposed within said switch housing and a handle disposed externally of said switch housing such that movement of said handle moves said toggle switch between off and on positions;

a spring disposed within said switch housing, a first end of said spring being connected to said base and a second end of said spring being connected to said lower portion of said toggle switch, said first end of said spring being limited to rotational movement only about a longitudinal axis thereof when said toggle switch moves between said off and on positions; and a spring housing disposed over at least a portion of said spring to prevent buckling of said spring when said spring moves with said toggle switch.

4. The switch assembly of claim 3, wherein said spring housing is substantially cylindrical.

5. The switch assembly of claim 3, wherein said spring is a helical spring.

6. The switch assembly of claim 3, wherein said base has a protrusion to which said first end of said spring is connected.

7. The switch assembly of claim 6, wherein said protrusion has a recess for receiving said first end of said spring.

8. The switch assembly of claim 3, wherein said spring housing is rotatable about said spring.

9. The switch assembly of claim 8, wherein axial movement of said spring housing is limited by said toggle switch at a first end and said base at a second end.

10. A switch assembly, comprising:

a base;

a cover connected to the base to form a switch housing;

first and second contact terminals connected to said switch housing;

a contact arm connected to said first contact and having a first contact member disposed at a free end of said contact arm;

a second contact member connected to said second contact terminal;

a toggle switch having a lower portion disposed within said switch housing and a handle disposed externally of said switch housing, and being pivotally movable between off and on positions;

a trunnion disposed on said toggle switch and engaging said contact arm;

a spring disposed within said switch housing and biasing said toggle switch toward said on and off positions, respectively, depending on positioning thereof, a first end of said spring being connected to said base and a second end of said spring being connected to said lower portion of said toggle switch; and a spring housing disposed over at least a portion of said spring to prevent buckling of the spring when said spring moves with said toggle switch;

whereby when said toggle switch is in said on position said trunnion moves said contact arm such that said first contact member contacts said second contact member, and when said toggle switch is in said off position said trunnion allows movement of said contact arm away from said second contact terminal such that said first contact member is spaced from said second contact member.

11. The switch assembly of claim 10, wherein said first end of said spring is fixedly connected to said base to substantially prevent movement of said first end of said spring.

12. The switch assembly of claim 10, wherein said spring housing is substantially cylindrical.

13. The switch assembly of claim 10, wherein said spring is a helical spring.

14. The switch assembly of claim 10, wherein first and second stops are disposed in said housing to limit movement of said toggle switch.

15. The switch assembly of claim 10, wherein said contact arm is biased to move away from said second contact terminal.

16. The switch assembly of claim 10, wherein a mounting strap is connected to said switch housing to secure said switch assembly to an electrical box.

17. The switch assembly of claim 10, wherein said trunnion has first and second portions, said first portion engaging said contact arm when said toggle switch is in said off position and said second portion of said trunnion engaging said contact arm when said toggle switch is in said on position.

18. The switch assembly of claim 10, wherein said base has a protrusion to which said first end of said spring is connected.

19. The switch assembly of claim 18, wherein said protrusion has a recess for receiving said first end of said spring.

20. The switch assembly of claim 10, wherein said spring housing is rotatable about said spring.

21. The switch assembly of claim 20, wherein axial movement of said spring housing is limited by said toggle switch at a first end and said base at a second end.

* * * * *